United States Patent [19]
Kasuga et al.
[11] 4,159,039
[45] Jun. 26, 1979

[54] METHOD AND AN APPARATUS OF DRIVING AN ARTICLE AND EXTRACTING BY STRAIN ENERGY

[75] Inventors: Masami Kasuga, Tokyo; Tetsuzo Hirose, Yokosuka; Tsunematsu Yoshida, Tokyo; Toshio Shinohara, Yokohama, all of Japan

[73] Assignee: Nippon Kokan Kabushiki Kaisha, Tokyo, Japan

[21] Appl. No.: 902,428

[22] Filed: May 3, 1978

[30] Foreign Application Priority Data

May 4, 1977 [JP] Japan ..... 52-51603
May 4, 1977 [JP] Japan ..... 52-51604

[51] Int. Cl.[2] ..... B25D 9/00
[52] U.S. Cl. ..... 173/1; 173/91; 173/171
[58] Field of Search ..... 116/137 R, 137 A; 173/1, 90, 91, 116, 171, 49, 119, 123; 175/56; 405/232

[56] References Cited

U.S. PATENT DOCUMENTS

| | | | |
|---|---|---|---|
| 3,008,528 | 11/1961 | Berthet et al. | 173/49 |
| 3,162,252 | 12/1964 | Cobi | 173/91 |
| 3,382,841 | 5/1968 | Bouyoucos | 116/137 A |

FOREIGN PATENT DOCUMENTS

| | | | |
|---|---|---|---|
| 159467 | 4/1964 | U.S.S.R. | 173/123 |

*Primary Examiner*—Lawrence J. Staab
*Attorney, Agent, or Firm*—Flynn & Frishauf

[57] ABSTRACT

The invention is to drive an article into an object or extract it therefrom by means of strain energy.

The article is provided at its top with an elastic part having a reaction material for giving a tensile strain or a compressive strain to the elastic part via the reaction material in order to accumulate the strain energy in the elastic part.

For carrying out the driving operation, the strain energy is abruptly released from the top of the elastic part, otherwise the compressive strain is abruptly released from the bottom of the elastic part. The strain energy is transformed into a kinetic energy and the article is struck on its head by this kinetic energy so that a compressive strain wave is generated in the article being driven.

For carrying out the extracting operation, the compressive strain is abruptly released from the top of the elastic part, otherwise the tensile strain is abruptly released from the bottom of the elastic part. The strain energy is transformed into the kinetic energy and the elastic part having received this kinetic energy gives the impact force to the driven article in the extracting direction.

15 Claims, 14 Drawing Figures

METHOD AND AN APPARATUS OF DRIVING AN ARTICLE AND EXTRACTING BY STRAIN ENERGY

BRIEF DESCRIPTION OF THE INVENTION

This invention relates a method and an apparatus of moving the article by means of strain energy, and more particularly to operations of driving into or extracting from the object such as the ground and others the article such as piles, sheet piles, stakes and the like by means of the strain energy.

In the drivings of the piles, the sheet piles or the stakes in the object as the ground, or in the extractions therefrom for the construction of the structures, there have been known the striking process, the vibration process, the static penetrating and extracting process, or the burying-digging process. In them, the striking process is known as the drop hammer process which directly drops the weight onto the article, the Diesel pile hammer process which compresses fuel oil gas and explodes it to provide the striking force by explosion, and the steam hammer process which utilizes the pressure of the steam. Since each of them performs the driving by striking, noise and vibration are inevitable and causes serious problems especially in urban areas. In order to develop such circumstances, the cover is prepared around the machinery but it makes the operation inefficient because of big scaled additional provisions. Besides, since the striking processes all make use of the gravity, the lateral or oblique strikings are difficult. In the vibration process, the weights for making eccentricity are provided on symmetrical axes of the even-number more than two, for example, as in the vibrohammer, and the weight eccentric in perpendicularity and provided symmetrically are rotated in opposite directions relative to each other in order to eliminate horizontal force. In such manners, as the driving and extracting are operated, the operating ability is lacked owing to the nature of vibration, and especially it is difficult to drive into stiff stratum. Further the lateral and oblique operations are difficult.

The static process is to penetrate or extract the article by means of the static power. If the ground is hard this process is insufficient in its operating ability and therefore it is necessary to associate another process such as vibrating the articles to be driven. Since the driving and the extracting are performed by the static force, resistance near the ultimate static friction acts around the article and causes large resistance against the operation, and the reacting force equivalent to the penetrating or the extracting forces is required, and therefore large sacled reacting apparatuses should be installed.

Finally, the burying-digging process is that in burying, the ready-made stakes or sheet piles are positioned in the holes having been in advance made in the object, or reinforcing steel bars are positioned in said hole, into which the concrete is filled up. In this process the working steps increase and the object is in advance excavated so that the object is disturbed to weaken the supporting capacity of the article. In digging, the object around the article is removed by means of appropriate ways. In this process the digging is difficult or impossible if the object is the soft ground, if the article is very long or if the article is in the water.

The present invention is to remove the shortcomings of the prior art. It is a primary object of the invention to provide a method and an apparatus of efficiently driving and extracting the article with less noise and vibration.

It is a second object of the invention to provide a method and an apparatus of carrying out operations not only in the perpendicular direction relative to the object but also in the oblique or the horizontal directions.

It is a third object of the invention to provide a method and an apparatus having large operating ability.

It is a fourth object of the invention to provide a method and an apparatus not requiring any reacting mechanism.

It is a fifth object of the invention to provide a method and an apparatus with less operating steps.

It is a sixth object of the invention to provide a method and an apparatus of driving with good supporting the article.

It is a seventh object of the invention to provide a method and an apparatus of easily enabling the operation even if the object is the soft ground, the article is extremely long or the article is in the water.

SUMMARY OF THE INVENTION

For accomplishing these objects, the invention is basically characterized in that an elastic part having a reaction material is furnished to the article on its head, and the strain energy is accumulated in the elastic part through the reaction material, after which the strain energy is abruptly released to be transformed into the kinetic energy, so that the article is driven or extracted by means of this kinetic energy.

Figure 1:
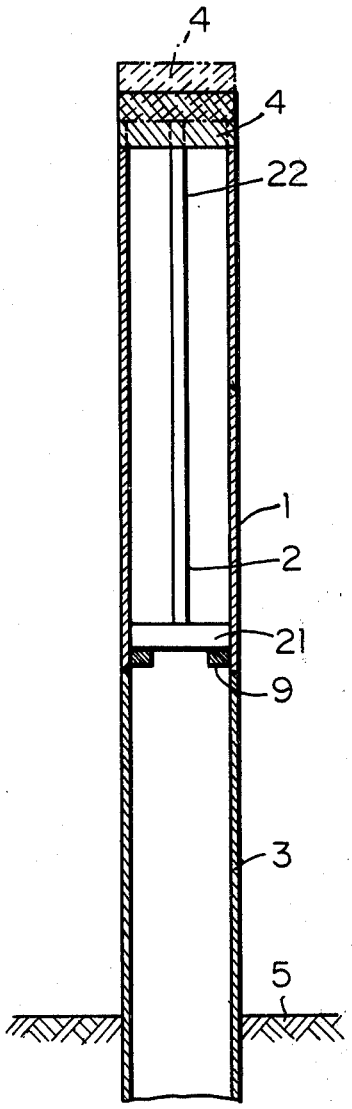
FIG. 1 is a cross sectional view schematically showing a basic embodiment of the driving operation according to the inventive method.

In the drawings, a reference numeral 1 is an elastic part, 2 is a reaction material, 3 is a body driven into the article, 4 is strain energy releasing mechanism, 5 is an object to receive the body 3, 6 and 9 are members, 7 is an engaging member, 10 is a fluid cylinder, 11 is a piston rod, 12 is a fluid conduit, and 13 is a member.

DETAILED DESCRIPTION OF THE INVENTION

In the invention, the elastic part having the reaction material is provided to the article on its head which is to be driven into the object or extracted therefrom, and then the reaction material is effected with compressive reaction by means of a strain giving mechanism to give the strain to the elastic body so that the elastic body is caused to accumulate the strain energy therein. Subsequently, when this strain energy is rapidly released, it is changed into kinetic energy for performing the driving or the extracting operation.

The releasing condition of the strain energy is different in accordance with driving or extracting the article. It is also different in accordance with the compressive strain or the tensile strain relative to the elastic part.

Figure 2:
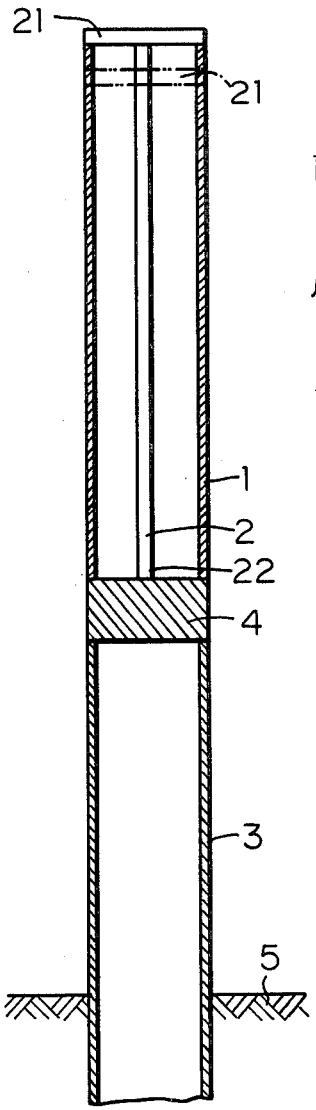
FIG. 2 is a cross sectional view showing another basic embodiment according to the inventive method, FIG. 3(*a*) and (*b*) explain a non-loading condition and a strain energy accumulating condition in the embodiment in FIG. 1, respectively, FIG. 4(*a*) to (*f*) stepwisely explain changes of the stress conditions in the embodiment in FIG. 1, FIG. 5(*a*) and (*b*) explain a non-loading condition and a strain energy accumulating condition in the embodiment in FIG. 2, respectively, FIG. 6(*a*) to (*f*) stepwisely explain changes of the stress conditions in the embodiment in FIG. 2.

Reference wil be at first made to a case of driving the article into the object. FIG. 1 and FIG. 2 show the two basic embodiments of the driving method according to the invention. FIG. 1 shows that the strain energy is obtained by the tensile strain, and FIG. 2 shows that the strain energy is obtained by the compressive strain. A reference numeral 3 designates the article such as the stake or steel sheet pile and 5 shows the object such as the earth into which the article is driven. The article 3 is provided on its head with an elastic body or an elastic-plastic body 1 (briefly called as "elastic body" hereafter) comprising a rod or a metallic pipe. In regard to a relation between the elastic body 1 and the article 3, it is a necessary condition that the both are contacted each other at driving, but a fixed connection is not always necessary and a non-fixing as contacting may be allowed.

In the embodiment shown in FIG. 1, the elastic part 1 is provided on its head with a strain energy releasing mechanism 4 (briefly called as "mechanism 4" hereafter), and at its lower portion with one end 21 of the reaction material 2 via a member 9 while another end 22 thereof is connected to the mechanism 4. On the other hand, in the embodiment in FIG. 2, the elastic part 1 is provided on its bottom with said mechanism 4, and at its upper portion with one end 21 of the reaction material 2 while another end 22 thereof is connected to the mechanism 4.

In this instance, the connection between the one end 21 of the reaction material 2 and the elastic part 1 may be fixed or contacted (not fixed), and the connection between the other end 22 of the reaction material 2 and the mechanism 4 may be optional in dependance on the releasing of the strain energy. That is, the mechanism 4 is for releasing the strain energy accumulated in the elastic part, and the connection thereof is effected with the both of the elastic part 1 and the reacton material 2 or with the elastic part 1 only or with the reaction material 2 only, and as far as the mechanism 4 enables to abruptly release the strain energy, it may be a separate mechanism from the elastic part 1 and the reaction material 2.

Figure 3:
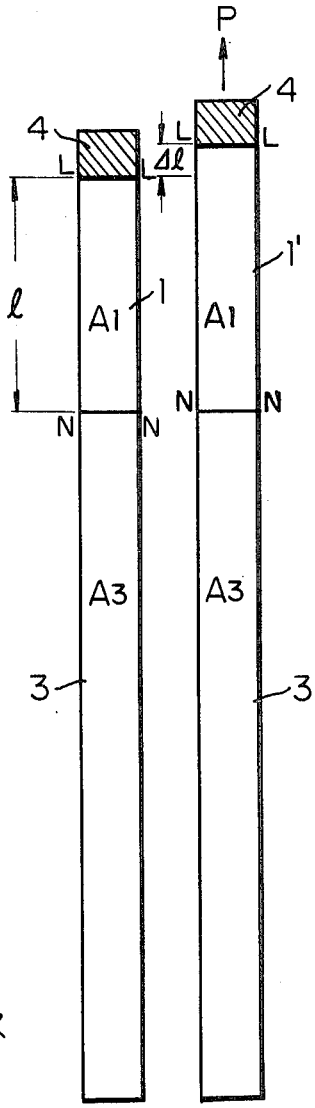

Under the above mentioned condition, the strain giving mechanism (not shown) causes the reaction material 2 to be given compressive reaction for giving the tensile strain to the elastic part 1, whereby the elastic part 1 is deformed as shown with a phantom line in FIG. 1 for accumulating the strain energy therein. In other words, assuming that the bottom of the elastic part 1 is at a level N—N, the head is at a level L—L, and the length of the elastic part 1 is l, the elastic part 1 changes from a length l of a non-loading condition shown in FIG. 3(*a*) and make a displacement of $\Delta l$ by force P in FIG. 3(*b*). This is a condition that the strain energy is accumulated. The elastic part 1 becomes a strain energy accumulator 1' (briefly called as "accumulator 1'" hereafter) in accordance with the deforming amount of $\Delta l$, and the amount U of the strain energy accumulated in this accumulator 1' is expressed with $$U=(\tfrac{1}{2})P(\Delta l) \qquad \text{(I)}$$

Figure 4:
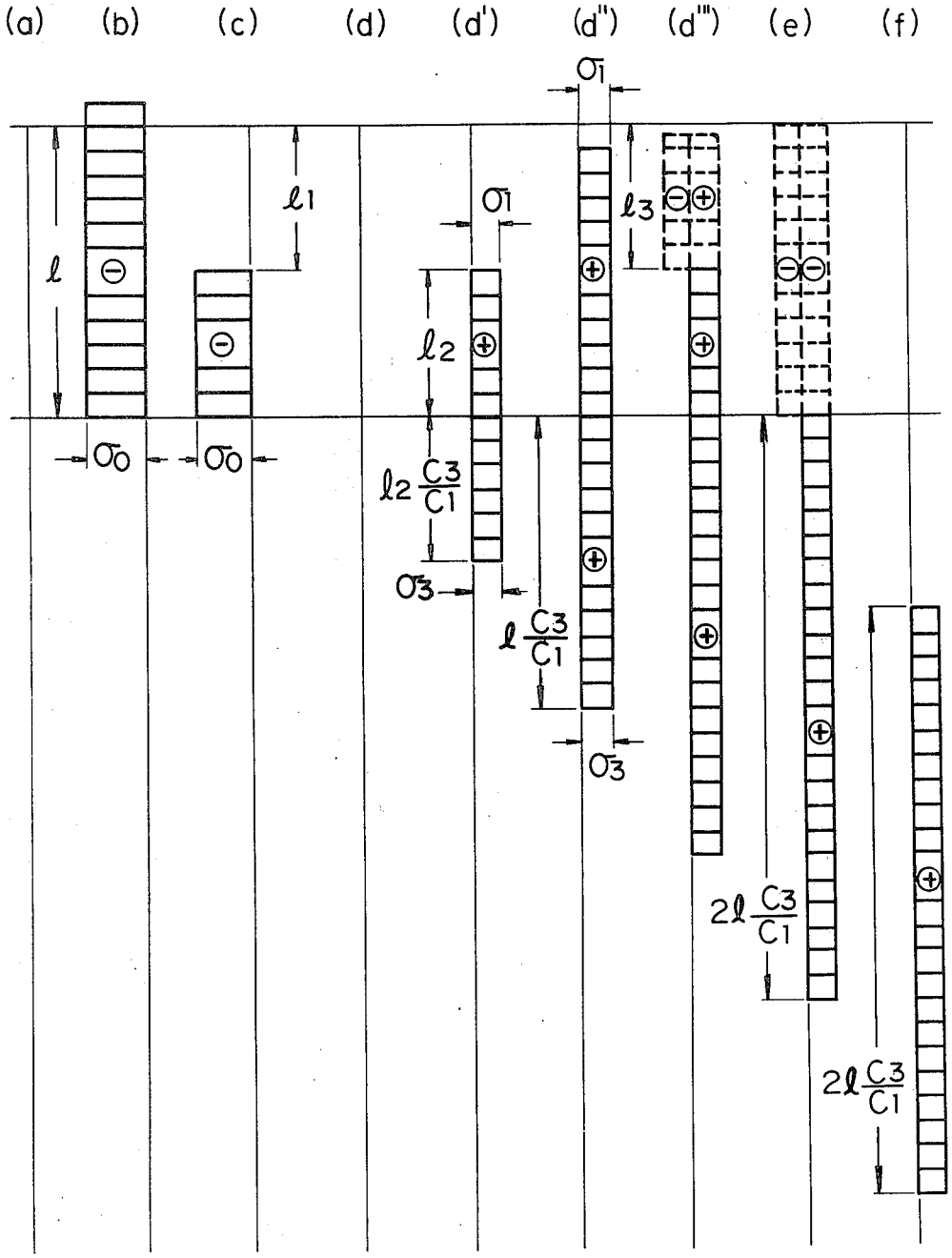

A stress level $\sigma o$ in the accumulator 1' under this condition is, promising the tensile stress as minus, expressed with $$\sigma o=-P/A_1=-E_1(\Delta l/l) \qquad \text{(II)}$$

where, $A_1$ is an available cross sectional area of the accumulator $E_1$ is an elastic modulus of the accumulator This stress condition is shown in FIG. 4(*b*). FIG. 4(*a*) shows the stress condition at the non-loading condition of the accumulator 1', that is, the elastic part 1 itself in FIG. 1.

In this instance, tension of the elastic part 1 via the reaction material 2 for accumulating the strain energy in the elastic part 1 may be obtained by the mechanical, electrical or hydraulic pressure means.

Once the strain energy is accumulated in the accumulator 1' by means of the tension as mentioned above, the relationship between the accumulator 1' and the reaction material 2 is rapidly broken by means of the mechanism 4 at the top of the accumulator 1', whereby the tensile strain in the accumulator 1' is released from the top of the accumulator 1', and a region where the strain is released is at a kinetic condition at velocity V in downward condition in FIG. 1, and this strain released region is spread from the head of the accumulator 1' to the bottom thereof (it does not mean that the strain energy is transmitted from the middle part to the head and the bottom of the accumulator).

The spreading velocity $C_1$ of the released region is $$C_1=\sqrt{E_1/\sigma_1} \qquad \text{(III)}$$

where, $\sigma_1$ is density of the accumulator.

After the strain energy is released from the head of the accumulator 1', the stress condition at the elapsing time $\Delta t_1=L_1/C$ is shown in FIG. 4(*c*), and in a part of $l_1$, by releasing the strain energy, the tensile strain is released and the tensile stress fades away, and instead a downward displacing velocity V appears. This displacing velocity is expressed with an under mentioned relation $$V=-(-\sigma o)/E_1\,C_1 \qquad \text{(IV)}$$

The releasing of the stress is not spread in the remaining part where the full length l of the elastic part 1 is less $l_1$, and the above mentioned initial stress condition (the condition of accumulating the strain energy) is maintained. In this instance, releasing of the strain energy from the top of the accumulator 1' may depend on the mechanical, electrical hydraulic pressure or gas pressure means which applies the strain energy.

FIG. 4(*d*) shows stress conditions at the elapsing time $\Delta t_2 = l/C_1$ after releasing the strain energy from the top of the accumulator 1'. The strain energy of the accumulator 1' is released from the top thereof at the spreading velocity $C_1$ and the entire region of l obtains the displacing velocity V. That is, FIG. 4(*d*) is moment when the article 3 will be struck by the accumulator 1' the strain energy of which is all transformed into the kinetic energy, and the accumulator 1' and the article 3 are not generated with any stress.

The displacing velocity V may be obtained with the equation (IV), and since it is considered that this situation is the same as a colliding instance of a substance having the velocity V, the most efficient striking theory in the dynamics may be applied to driving of the article into the object.

The kinetic energy $U_1$ of the accumulator 1' under the condition in FIG. 4(*d*) is expressed with $$U_1 = (\tfrac{1}{2}) A_1 l \sigma V^2 \qquad \text{(V)}$$

This is equal to $(\frac{1}{2})P(\Delta l)$ and is the same magnitude as the strain energy initially accumulated.

FIG. 4(*d'*) shows conditions at an elapsed time $\Delta t_3 = (l + l_2)/C_1$ after releasing the strain energy from the head of the accumulator 1'. This condition is at time when a compressive stress wave is transmitted over the accumulator 1' by length $l_2$ and the article 3 by length $l_2 \times C_3/C_1$, which compressive stress wave is generated by collision between the article 3 and the bottom of the accumulator 1' just after the strain energy has been released over the full length of the accumulator 1'. The compressive stress wave is generated in the both of the accumulator 1' and the article 3, according to the impact theory, after the condition shown in FIG. 4(*d*), and the compressive stress wave generated in the accumulator 1' is transmitted toward the head of the accumulator 1∝ while the compressive stress wave generated in the article 3 is transmitted toward the tip of the article 3. Now assuming that the accumulator 1' and the article 3 are the elastic parts, the levels of the transmitting stresses are shown as an equation (VI) and an equation (VII).

$$\sigma_1 = \{A_3\sqrt{E_3\sigma_3}/(A_1\sqrt{E_1\rho_1} + A_3\sqrt{E_3\rho_3})\}\cdot\sqrt{E_1\rho_1}\,V \qquad \text{(VI)}$$

$$\sigma = \}A_1\sqrt{E_1\rho_1}/(A_1\sqrt{E_1\rho_1} + A_3\sqrt{E_3\rho_3})\}\cdot\sqrt{E_3\rho_3}\,V \qquad \text{(VII)}$$

where $A_3$ is an available cross sectional area of the article.

$E_3$ is an elastic modulus of the article.

FIG. 4(*d*) shows conditions at an elapsing time $\Delta t_3 = 2l/C$ after releasing the strain energy from the head of the accumulator 1'. As mentioned above, this condition is at time when the stress wave generated due to the collision between the accumulator 1' and the article 3, reaches up to the head in the accumulator 1' and reaches by the length $1 \times C_3/C_1$ in the article 3, where $C_3 = \sqrt{E_3/\rho_3}$.

FIG. 4(*d''*) shows conditions at an elapsed time $\Delta t_4 = (2l + l_3)/C$ after releasing the strain energy from the head of the accumulator 1'. This condition is at time when the compressive stress wave having reached up to the head of the accumulator 1', reflects to change into the tensile stress wave and transmits a length $l_3$. Now assuming that said head is under free end condition, the compressive wave of the accumulator 1' is reflected thereat with a tensile stress wave which is the same with the compressive wave in the absolute value and is reverse in positive and negative to the compressive wave, and therefore the region of $l_3$ in FIG. 4(*d'*) takes the stress condition as shown with the phantom line, any any stress is not caused due to offsetting. On the other hand, in the article 3 the compressive stress wave is transmitted a length $(l + l_3) \times C_3/C_1$.

FIG. 4(*e*) shows conditions at an elapsing time $\Delta t_3 = 3l/C$ after releasing the strain energy from the head of the accumulator 1'. This condition is at the time when the compressive stress wave having reached up to the head of the accumulator 1' reflects to change into the tensile stress wave and transmits from said head over the full length 1 of the of the elastic part, and the accumulator 1' is offset, as shown with the phantom line in FIG. 4(*e*), by the stress wave which is the same with the compressive stress wave in the absolute value and is reverse thereto in positive and negative, so that any stress is not caused in the accumulator 1'. In this connection, if the accumulator 1' and the article 3 are not connected (that is, not transmitting the tensile strength), they are separated by the tensile stress wave reflected from the head of the accumulator 1'. On the other hand, in the article 3 the compressive stress wave is transmitted by the length $(2) \times C_3/C_1$ and at this time since the accumulator 1' and the article 3 are separated, the compressive stress wave with this length is transmitted to the tip of the article 3. FIG. 4(*f*) shows conditions of th compressive stress wave transmitting in the article 3. The compressive stress wave in FIG. 4(*f*) transmits in the article 3 and destroys the object 5 so that the article 3 is caused to drive into the object 5.

Figure 5:
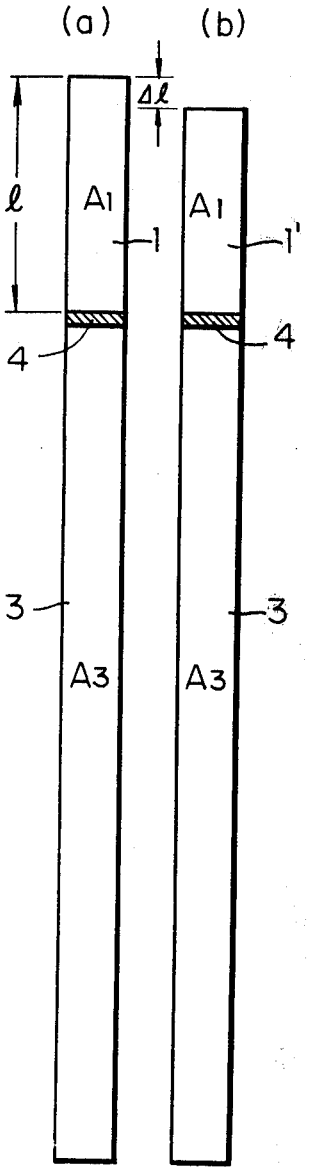

In the embodiment shown in FIG. 2, the reaction material 2 is effected with a tensile reaction to give the compressive strain, due to the compressive force, to the elastic part 1 (this manner may also depend on the mechanical, electrical, hydraulic pressure or gas pressure applying means, similarly to the embodiment in FIG. 1) in order to provide the deforming condition shown with the phantom line in FIG. 2 for accumulating the strain energy. That is, conditions in FIG. 5(*a*) and FIG. 6(*a*) are non-loadings from which conditions $(l - \Delta l)$ in FIG. 5(*b*) and FIG. 6(*b*) are provided. Thus, the elastic part 1 becomes the strain energy accumulator 1'. The amount U' of the strain energy in the accmulator 1' is expressed with $$U' = (\tfrac{1}{2}) P \Delta l \qquad \text{(I')}$$

and the stress level $\sigma_o$ at this time is expressed with $$\sigma_o = P/A_1 \qquad \text{(II')}$$

Figure 6:
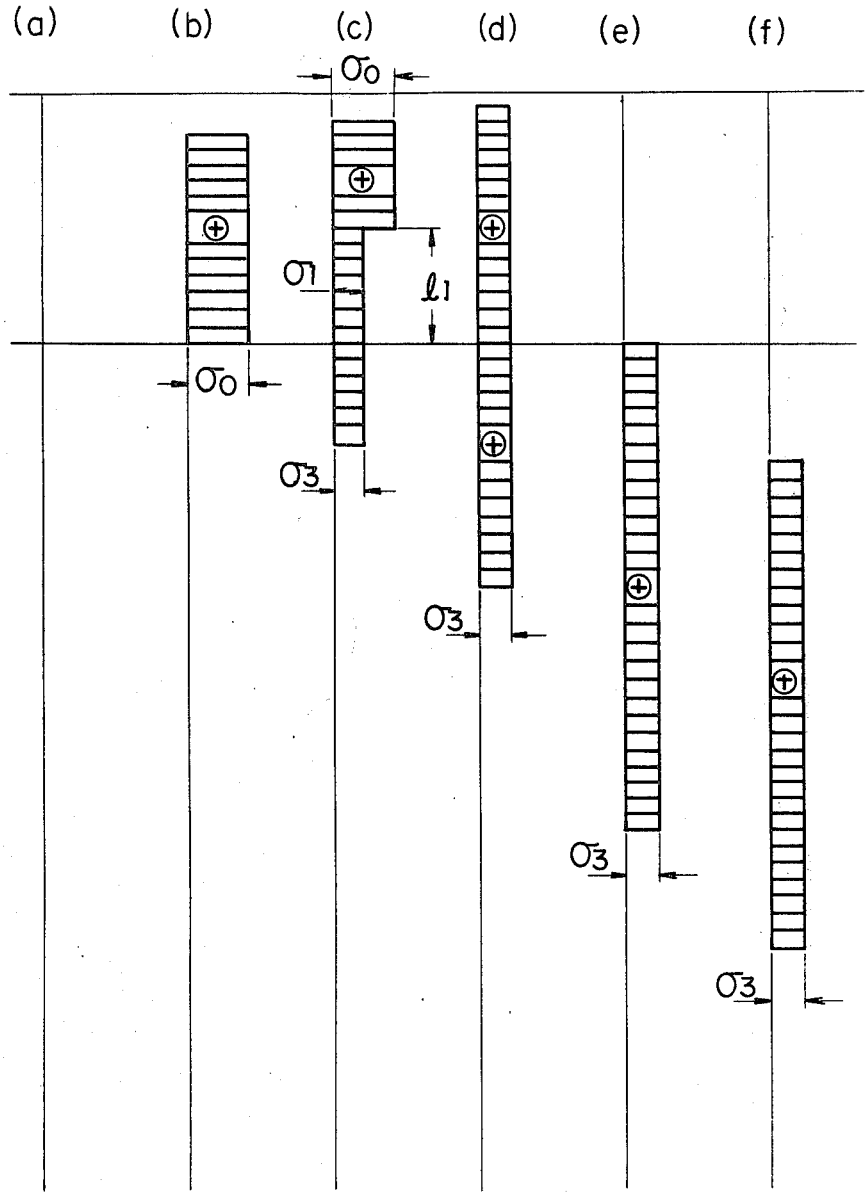

Subsequently, the relationship between the accumulator 1' and the reaction material 2 is abruptly broken by means of the mechanism 4 installed between the top of the article 3 and the bottom of the accumulator 1' (the breaking manner may depend on the mechanical, electrical, hydraulic pressure or gas pressure means, similarly to the embodiment in FIG. 1), and the compressive strain energy accumulated in the accumulator 1' is released from the bottom of the accumulator 1'. In such a way, the released strain spreads the stress releasing region toward the head at the stress transmitting velocity $C_1$ from the bottom of the accumulator 1'. The velocity $C_1$ at this time is that same in the above mentioned equation (III). FIG. 6(*c*) shows the stress conditions in the accumulator 1' and the article 3 in the elapsing time $\Delta t_1 = l_1/C_1$ after having released the strain energy from the bottom of the accumulator 1'. The level $\sigma_1$ of the stress wave reflected in the accumulator 1' and the level $\sigma_3$ of the stress wave transmitted to the article 3 can be obtained from the equation (VI) and the equation (VII), respectively.

The driving process in FIG. 1 and that in FIG. 2 are greatly different in that, in FIG. 1, the strain energy of the accumulator 1' is all transformed into the kinetic energy, and at this time this kinetic energy starts to act on the article, and on the other hand, in FIG. 2, the strain energy of the accumulator 1' is released at its bottom, and just at the time when this releasing region is transmitting to the head the kinetic energy changed from the strain energy, the kinetic energy acts on the article 3. However, the driving process in FIG. 2 finally reaches to the same stress condition (FIG. 6(*d*)) as in FIG. 1 after passing through the stress condition of $\Delta t_2 = l/C_1$ after releasing the strain energy (refer to FIG. 6(*d*)), and subsequently the compressive wave transmits over the article 3 and destroys the object 5 to cause the article 3 to drive into the object 5.

In this respect, the discussion with reference to FIG. 1 and FIG. 2 is based on the elastic theory and does not take losses owing to the heat or noise into consideration.

Another embodiment concerning the driving process according to the inventive method will be referred to. This process changes the elastic part 1, the reaction material 2 and the material properties in FIG. 1 especially as an under mentioned expression $$E_1/\rho_1 > E_2/\rho_2 \qquad \text{(VIII)}$$

where, $E_1$ is an elastic modulus of the elastic part, $E_2$ is an elastic modulus of the reaction material. $\rho_1$ is a density of the elastic part, and $\rho_2$ is a density of the reaction material.

This means to use such material properties that the stress transmitting velocity C as shown in the said equation (III) changes as shown in an under mentioned expression $$\sqrt{E_1/\rho_1} = C_1 > C_2 = \sqrt{E_2/\rho_2} \qquad \text{(IX)}.$$

where, $C_1$ is stress transmitting velocity of the elastic material, and $C_2$is stress transmitting velocity of the reaction material Under this condition, the strain energy is accumulated in the elastic part in the same way as in FIG. 1, and subsequently the strain energy is released by means of the mechanism 4. In such a way, if the strain energy is accumulated in the accumulator 1' is released by means of the mechanism 4 at the head of the elastic part 1, and being $C_1 > C_2$, the kinetic energy wave generated from the head of the accumulator 1' reaches to the bottom of the accumulator 1' faster than the kinetic energy wave generated in the reaction material 2 and thus the bottom of the accumulator 1' is displaced toward the article 3. As a result, the strain energy is released from the bottom of the reaction material. This means that the energy which is transmitted to the article in the same action as releasing the strain energy from the accumulator 1' in the embodiment in FIG. 2, is effected with addition of the energy from the reaction material 2 to the energy from the accumulator 1'. It is found that this action is very advantageous to the driving operation. In this embodiment, only one part of the full length of the reaction material 2 may be substituted with a material of $C_1 > C_2$.

A next reference will be made to embodiments extracting the article already driven in the object.

Figure 7:
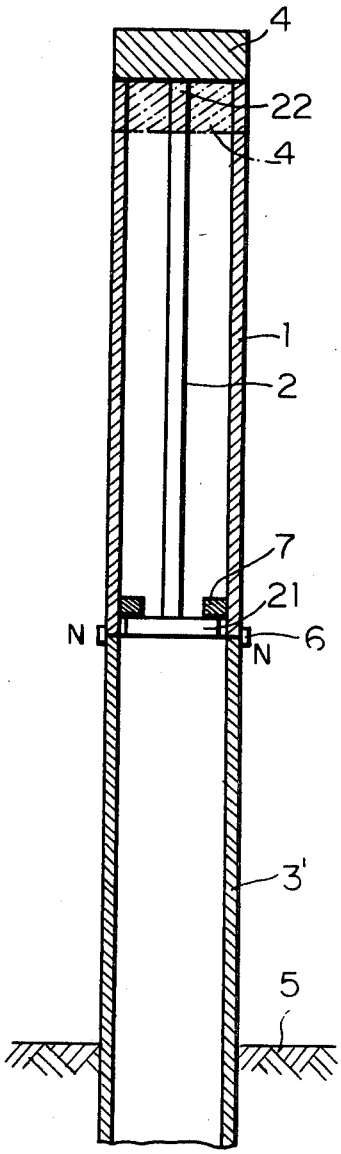
FIG. 7 is a cross sectional view schematically showing a basic embodiment of the extracting operation according to the inventive method.
Figure 8:
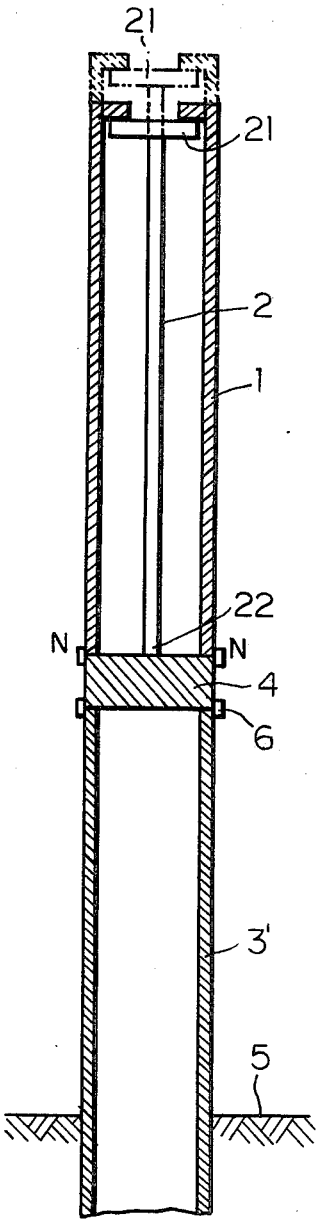
FIG. 8 is a cross sectional view showing another basic embodiment according to the inventive method, FIG. 9(*a*) and (*b*) explain a non-loading condition and a strain energy accumulating condition in the embodiment if FIG. 7, respectively, FIG. 10(*a*) to (*f*) stepwisely explain changes of the stress conditions in the embodiment in FIG. 7, FIG. 11(*a*) and (*b*) explain a non-loading condition and a strain energy accumulating condition in the embodiment in FIG. 8.

FIG. 7 and FIG. 8 show practical structures, in which FIG. 7 is a case providing the strain energy in compression, corresponding to FIG. 1 and FIG. 8 is a case providing the strain energy in tension, corresponding to FIG. 2. In each of these figures, a numeral 3' shows an already driven article such as the stake or the sheet pile, and a numeral 5 designates an object such as the ground. For extracting the article 3' from the object 5, the article is provided on its head with the elastic part having the reaction material and the strain energy releasing mechanism 4 (briefly called as "mechanism 4" hereafter). There is not provided a stress wave reflecting apparatus beside the mechanism 4.

In the embodiment in FIG. 7, the article 3' is connected (fixed) on its head with the elastic part 1 by means of a member 6, and the said elastic part 1 is integrally provided on its head with the mechanism 4, and the elastic part 1 is connected at its bottom (a contacting part with the article 3') with one end 21 of the reaction member 2 via an engaging member 7 as well as the other end 22 thereof is connected to the mechanism 4. On the other hand, in the embodiment shown in FIG. 8, the elastic part 1 is integrally provided at its bottom with the mechanism 4 so that the article 3' is connected (fixed) on its head with the mechanism 4, and the elastic part 1 is connected at its head with one end of the reaction material 2 as well as the reaction member 2 is connected to the mechanism 4.

In these instances, the elastic part 1 and the driven article 3' or the mechanism 4 and the article 3' must be fixedly connected differently from the already mentioned driving operation. The connections between the one end 21 of the reaction material 2 and the elastic part 1, or the other end 22 thereof and the mechanism 4 may be fixed or contacted (not fixed). The circumstances concerned are the same as in the driving operation.

In the embodiment in FIG. 7, the reaction material 2 is provided with tensile reaction to give the compressive strain to the elastic part 1, whereby the elastic part 1 is effected with a displacement shown with the phantom line in FIG. 7 to accumulate the strain energy therein.

Figure 9:
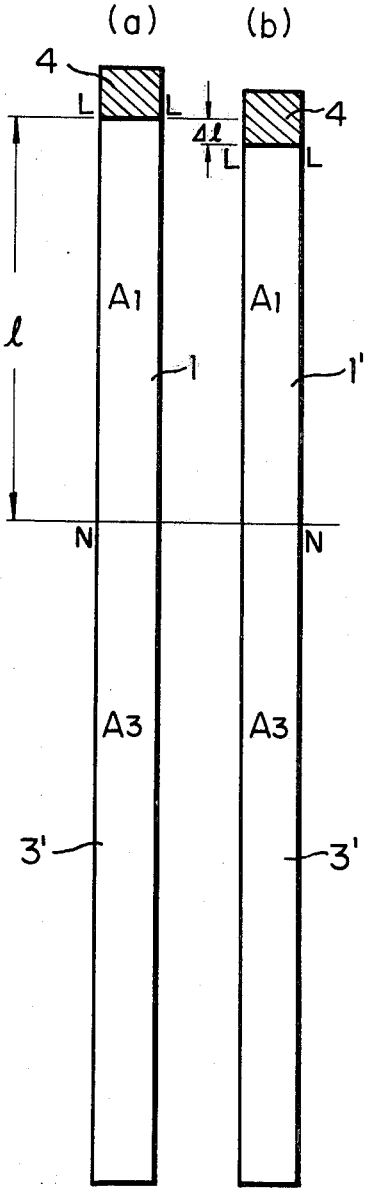

Now assuming that the bottom level of the elastic part 1 is N—N and the head level is L—L and the length of the elastic part 1 is l, the elastic part 1 makes a displacement AΔ by the compressive force P as shown in FIG. 9-(*b*) from the length l of the non-loading condition as shown in FIG. 9-(*a*). This is a condition that the strain energy is accumulated therein. Namely, the elastic part 1 becomes a strain energy accumulator 1' (briefly called as "accumulator 1'" hereafter) in accordance with the deformation of (Δl). The amount U of strain energy accumulated in the accumulator 1' is expressed with $$U = (\tfrac{1}{2})P(\Delta l) \qquad \text{(X-I)}$$

Figure 10:
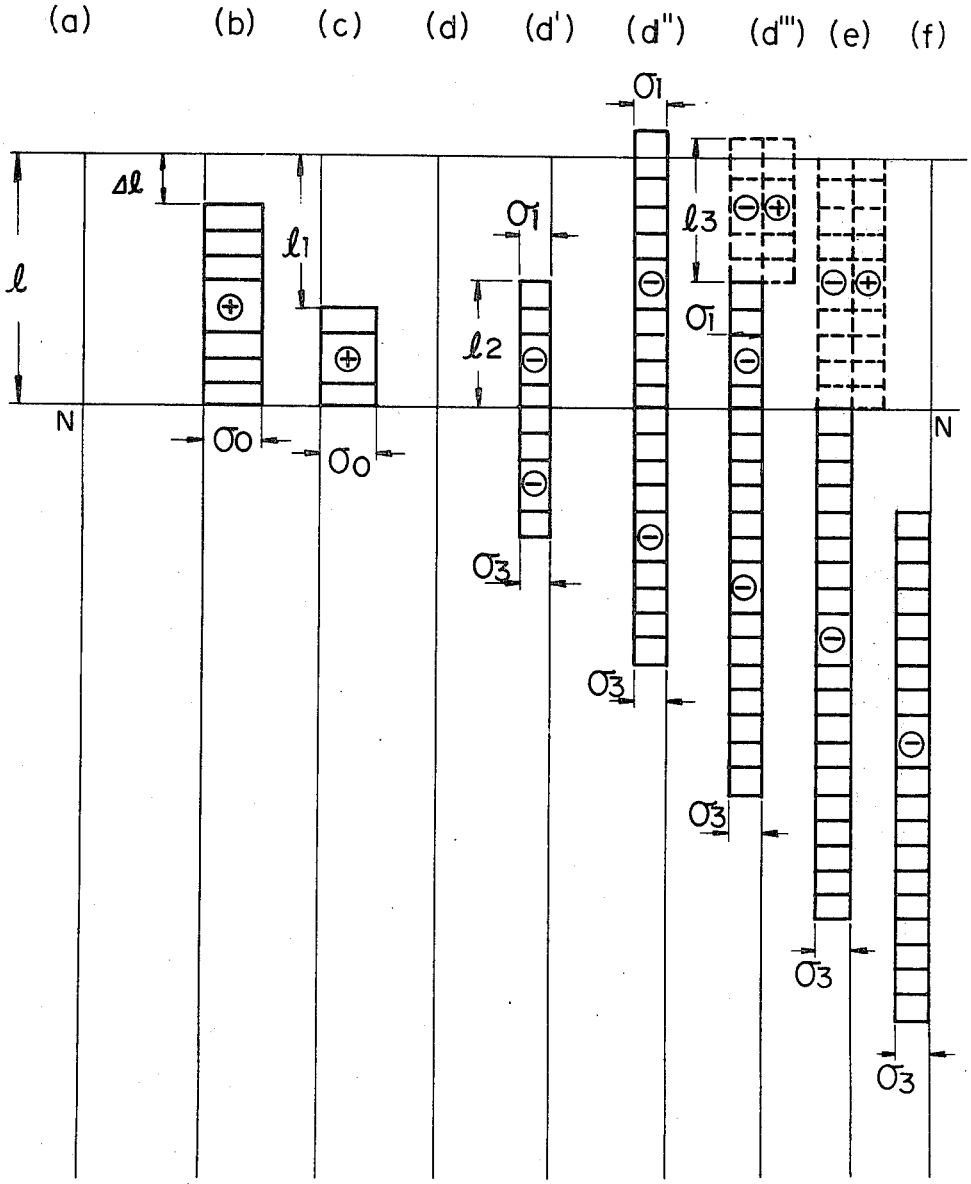

The stress level $\sigma_0$ in the accumulator 1' under this condition is, promising the compressive stress as plus, expressed with $$\sigma_0 = P/A_1 = E_1(\Delta l/l) \qquad \text{(X-II)}$$

where, $A_1$ is an available cross sectional area of the accumulator, and $E_1$ is an elastic modulus of the accumulator This stress condition is shown in FIG. 10–(*b*). FIG. 10–(*a*) shows a stress condition of a non-loading condition of the accumulator 1′, that is, the condition of the elastic part 1 in FIG. 7. Compression of the elastic part 1 via the reaction material 2 to accumulate the strain energy in the elastic part 1 may depend on the mechanical, electrical or fluid pressure means which applies the compression forces.

Once the strain energy due to the compression is accumulated in the accumulator 1′, the relationship between the accumulator 1′ and the reaction material 2 is abruptly broken by means of the mechanism 4 provided on the head of the accumulator 1′. The compressive strain in the accumulator 1′ is released from the head thereof thereby, and the region where the strain is released becomes the kinetic condition having the velocity V upward in FIG. 7, and the strain releasing region spreads toward the bottom of the accumulator 1′ from the head thereof.

The transmitting velocity $C_1$ in the strain releasing region at this time is $$C_1=\sqrt{E_1/\rho_1} \qquad \text{(X-III)}$$

where, $\rho_1$ is density of the accumulator.

FIG. 10(*c*) shows the stress condition at elapsing time of $\Delta t_1={}_1/C_1$ after releasing the strain energy from the head of the accumulator 1′, and in the part of $l_1$ the compressive strain is released by releasing the strain energy and the compressive stress fades away. Instead, an upward displacing velocity V appears. This displacing velocity v is expressed with $$V=(\sigma_0/E_1)C_1 \qquad \text{(X-IV)}$$

The part where the full length l of the elastic part 1 is less $l_1$ is not transmitted with releasing of the stress, and the above mentioned initial stress condition (the strain energy accumulating condition) is maintained. The releasing manner of the strain energy accumulated in the accumulator 1′ from the head thereof may depend on the mechanical, electrical, hydraulic pressure or gas pressure means for applying the strain energy.

FIG. 10(*d*) shows the stress condition of an elapsing time $\Delta t_2=l/C_1$ after releasing the strain energy from the head of the accumulator 1′. Namely, the strain energy is released from the head of the accumulator 1′ at the transmitting velocity $C_1$, and the displacing velocity V over the full length of l is obtained from the above said equation (X-IV). Since this condition is considered the same as the upward shock in FIG. 7 of a substance having the velocity V, the most efficient striking theory in the dynamics may be applied to extracting the substance from the object.

The kinetic energy amount $U_1$ of the accumulator 1′ under the condition in FIG. 10(*d*) is $$U_1=(\tfrac{1}{2})A_1 \qquad \text{(X-V)}$$

This is equal to $\frac{1}{2}/P(\Delta l)$ and is the same magnitude as the strain energy initially accumulated.

FIG. 10(*d*′) shows the conditions at an elapsing time $\Delta t_3=(l+l_2)/C_1$ after releasing the strain energy from the head of the accumulator 1′. This condition is at time when a tensile stress wave transmitted, at the same transmitting velocity as the said $C_1$ over the accumulator 1′ by length $l_2$ and at the velocity $C_3$ over the driven article 3′ by length $l_2\times C_3/C_1$ which tensile stress wave is generated by upward impact in FIG. 7 in the article 3′ from the bottom of the accumulator 1′ just after releasing the strain energy over the full length of the accumulator 1′. In the stress transmission from the accumulator 1′ to the article 3′, a tensile wave is generated in the both of the accumulator 1′ and the article 3, in the impact theory, after the condition shown in FIG. 10(*d*), and the tensile stress wave generated in the accumulator 1′ is transmitted toward the head of the accumulator 1′ while the tensile stress wave generated in the articles 3′ is transmitted toward the tip of the article 3′. Now assuming that the accumulator 1′ and the article 3′ are the elastic parts, the levels of the transmitting stresses are as an equation (X-VI) and an equation (X-VII).

$$\sigma_1=A_3\sqrt{E_3\rho_3}/(A_1\sqrt{E_1\rho_1}+A_3\sqrt{E_3\rho_3})\cdot\sqrt{E_1\rho_1}\,V \qquad \text{(X-VI)}$$

$$\sigma_3=A_1\sqrt{E_1\rho_1}/(A_1\sqrt{E_1\rho_1}+A_3\sqrt{E_3\rho_3})\cdot\sqrt{E_3\rho_3}\,V \qquad \text{(X-VII)}$$

where $A_3$ is an available cross sectional area of the article, $E_3$ is an elastic modulus of the article.

FIG. 10(*d*″) shows conditions of an elapsing time $\Delta t_3=2l/C_1$ after releasing the strain energy from the head of the accumulator 1′. As mentioned above, this condition is at time when the tensile stress wave generated due to the impact given to the article 3′ from the accumulator 1′, reaches up to the head of the accumulator 1′.

FIG. 10(*d*‴) shows conditions of an elastic time $\Delta t_4=(2l+l_3)/C_1$ after releasing the strain energy from the head of the accumulator 1′. This condition is at time when the tensile stress wave having reached up to the head of the accumulator 1′, reflects to change into the compressive stress wave and transmits a length $l_3$. Now assuming that the head of the accumulator 1′ is a free end portion, the reflection is provided, due to the free end condition, in the compressive stress wave which is the same in an absolute value as the tensile stress wave transmitted to the head of the accumulator 1′ and is reversed thereto in positive and negative. Therefore, the region of $l_3$ in FIG. 10(*d*‴) takes the stress condition as shown with the phantom line, and is offset so that the stress is not created. On the other hand, in the article 3′ the tensile stress wave is transmitted a length $(l+l_3)\times C_3/C_1$ FIG. 10(*e*) shows conditions at an elapsing time $\Delta t_3=3l/C_1$ after releasing the strain energy from the head of the accumulator 1′. This condition is at time when the tensile stress wave having reached up to the head of accumulator 1′ reflects to change into the compressive stress wave and transmits from said head over the full length l of the elastic part 1, and assuming that said head is under free end condition, the stress condition of the accumulator 1′ is, as shown with the phantom line in FIG. 10(*e*), reflected with a compressive stress wave which is the same with the tensile stress wave in the absolute value and is reverse in positive and negative to the tensile stress wave, and therefore any stress is not caused by a transmitting tensile stress wave.

In this point, the tensile stress wave generated in the article 3′ of length of $2l\times C_3/C_1$ is transmitted toward the tip of the article 3′. FIG. 10(*f*) shows conditions of the tensile stress wave transmitting in the article 3′. The tensile stress wave in FIG. 10(*f*) transmits in the article 3' and destroys the object 5 so that the article 3 is extracted from the object 5.

Figure 11:
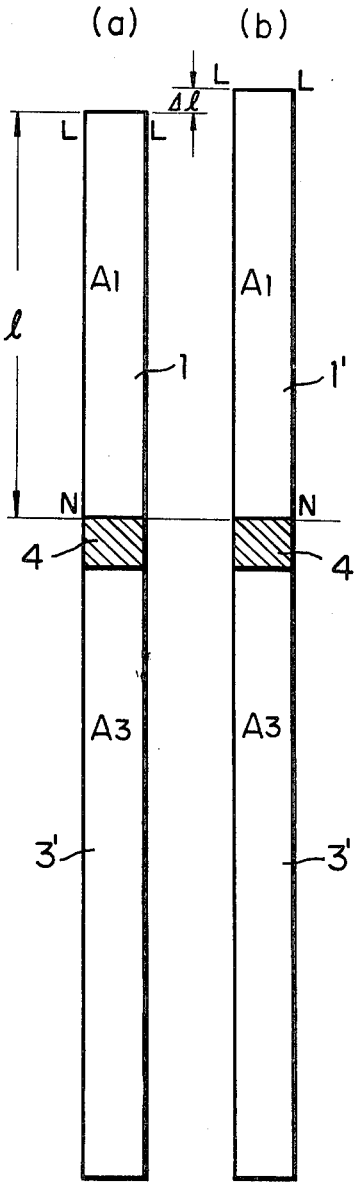

In the embodiment shown in FIG. 8, the reaction material 2 is effected with a compressive reaction to give the tensile force to the elastic part 1. This force may be also obtained by mechanical, electrical, hydraulic pressure or gas pressure means, similarly to the embodiment of FIG. 7, with providing the deforming condition shown with the phantom line in FIG. 8 for accumulating the strain energy. That is, conditions (l) in FIG. 11(*a*) and FIG. 12(*a*) are non-loadings from which conditions (l+Δl) in FIG. 11(*b*) and FIG. 12(*b*) are provided. Thus, the elastic part 1 becomes the strain energy accumulator 1'. The strain energy amount U' is $$U' = (\tfrac{1}{2})P\Delta l \qquad \text{(X-I')}$$

and the stress level $\sigma_0$ at this time is $$\sigma_0 = -P/A_1 = -E_1(\Delta l/l) \qquad \text{(X-II')}$$

Figure 12:
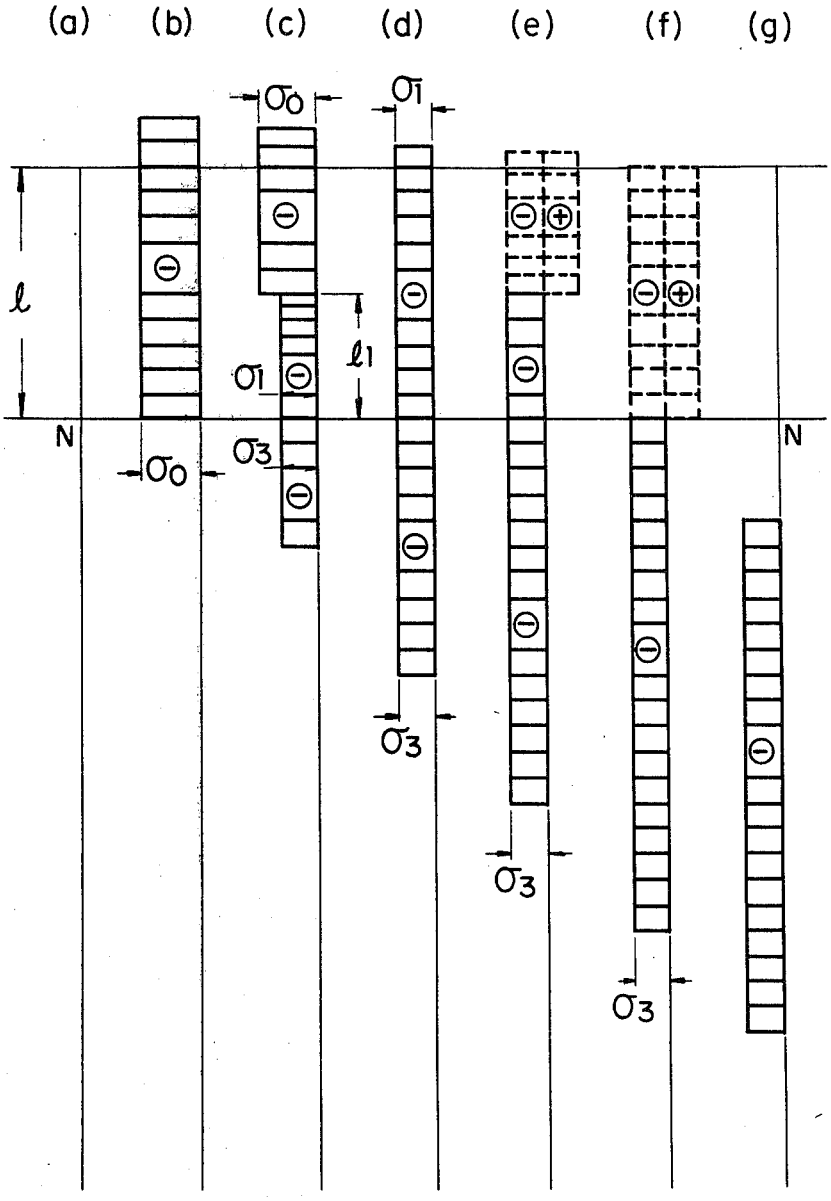
FIG. 12(*a*) to (*g*) stepwisely explain changes of the stress conditions in the embodiment in FIG. 8, and, FIG. 13 and FIG. 14 are cross sectional views schematically showing embodiments of apparatuses carrying out the method of FIG. 1.

Subsequently, the relationship between the accumulator 1' and the reaction material 2 is abruptly broken by means of the mechanism 4 installed between the top of the article 3' and the bottom of the accumulator 1' (the breaking manner may depend on the mechanical, electrical, hydraulic pressure or gas pressure means, similarly to the embodiment of FIG. 1), and the tensile strain energy accumulated in the accumulator 1' is released from the bottom of the accumulator 1'. In such a way, the released strain energy spreads the stress releasing region toward the head at the stress transmitting velocity $C_1$ from the bottom of the accumulator 1'. The velocity $C_1$ at this time is the same in the above mentioned equation (X-IV). FIG. 12(*c*) shows the stress conditions in the accumulator 1' and the article 3' in the elapsing time $\Delta t_1 = l_1/C_1$ after having released the strain energy from the bottom of the accumulator 1'. The level $\sigma_1$ of the stress wave reflected in the accumulator 1' and the level $\sigma_3$ of the stress wave transmitted to the article 3' can be obtained from the equation (X-VI) and the equation (X-VII), respectively.

The extracting process in FIG. 7 and that in FIG. 8 are greatly different in that, in FIG. 7, the strain energy of the accumulator 1' is all transformed into the kinetic energy, and at this time this kinetic energy starts to act on the article, and on the other hand, in FIG. 8, the strain energy of the accumulator 1' is released at its bottom, and just at the time when this releasing region is transmitting toward the head the kinetic energy changed from the strain energy, the kinetic energy acts on the article 3'. However, the driving process in FIG. 8 finally reaches to the same stress condition (FIG. 12(*f*)) as in FIG. 7 after passing through the stress condition of $\Delta t_2 = l/C_1$ after releasing the strain energy (refer to FIG. 12(*d*)), and subsequently the tensile wave transmits over the article 3' and destroys the object 5 to extract the article 3' from the object 5.

In this respect, the discussion with reference to FIG. 7 and FIG. 8 is based on the elastic theory and does not take losses owing to the heat or noise into consideration.

Another embodiment concerning the extracting process according to the inventive method will be referred to. This process changes the elastic part 1, the reaction material 2 and the material properties in FIG. 7 especially as an under mentioned expression $$E_1/\rho_1 > E_2/\rho_2 \qquad \text{(X-VIII)}$$

where, $E_1$ is an elastic modulus of the elastic part, $E_2$ is an elastic modulus of the reaction material, $\rho_1$ is a density of the elastic part, and $\rho_2$ is density of the reaction material This means to use such material properties that the stress transmitting velocity C as shown in the said equation (X-III) changes as shown in an under mentioned expression $$\sqrt{E_1/\rho_1} = C_1 > C_2 = \sqrt{E_2/\rho_2} \qquad \text{(X-IX)}$$

where, $C_1$ is stress transmitting velocity of the elastic material, and $C_2$ is stress transmitting velocity of the reaction material Under this condition, the strain energy is accumulated in the elastic part 1 in the same way as in FIG. 7, and subsequently the strain energy is released by means of the mechanism 4. In such a way, if the strain energy accumulated in the accumulator 1' is released by means of the mechanism 4 at the head of the elastic part 1, and being $C_1 > C_2$, the kinetic energy wave generated from the strain energy at the head of the accumulator 1' reaches to the bottom of the accumulator 1' faster than the kinetic energy wave generated from the strain energy at the head of in the reaction material 2, and thus the bottom of the accumulator 1' is displaced toward the head of the accumulator 1'. As a result, the strain energy is released from the bottom of the reaction material 2. This means that the energy which is transmitted to the article in the same action as releasing the strain energy from the accumulator 1' in the embodiment in FIG. 8, is effected with addition of the energy from the reaction material 2 to the energy from the accumulator 1'. It is found that this action is very advantageous to the extracting operation. In this embodiment, only one part of the full length of the reaction material 2 may be substituted with a material of $C_1 > C_2$.

From the above explanations, those skilled will conceive many other embodiments and various apparatuses for realizing the method according to the invention.

Figure 13:
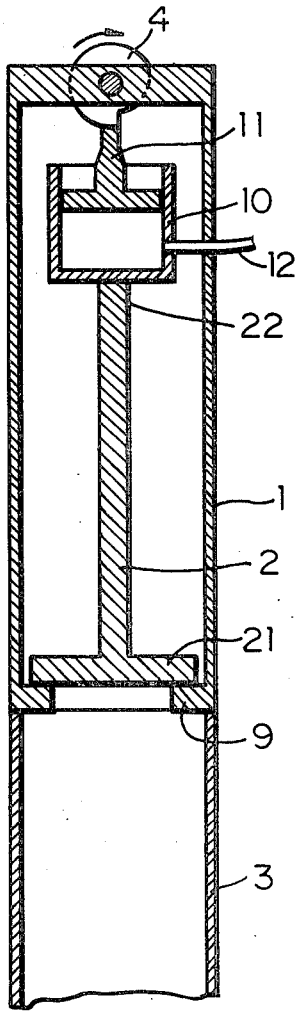
Figure 14:
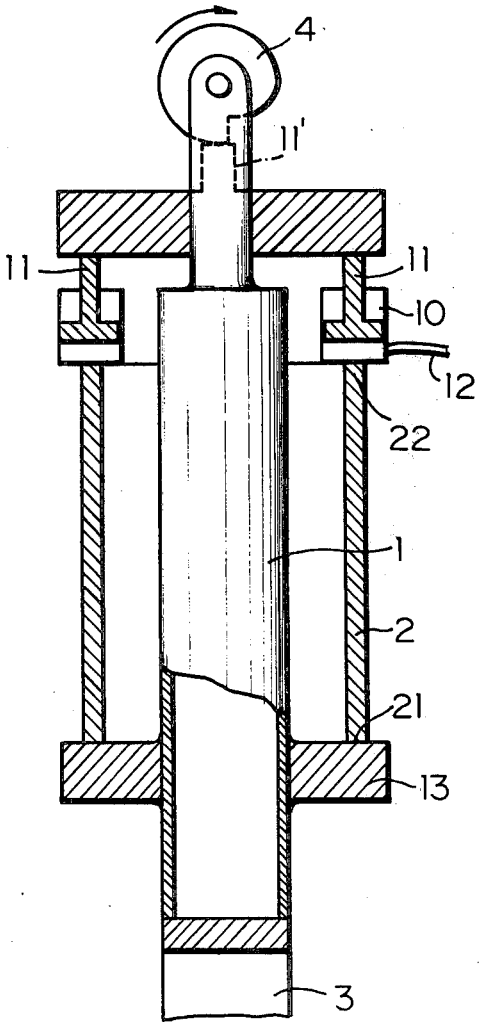

FIG. 13 shows one example of an apparatus for putting the method in FIG. 1 into practice, in which the elastic part 1 is provided on its top with a cam for the strain energy releasing mechanism 4, and a reaction material 2 of a rod shape is built in the elastic part 1, as well as the reaction material 2 is furnished on the other end 22 with a fluid cylinder 10 for the strain giving mechanism, and a piston rod 11 of the fluid cylinder 10 is engaged with the mechanism 4. FIG. 14 also shows another example of an apparatus for practising the method in FIG. 1, in which the elastic part 1 is arranged at an outer circumference with a pipe coaxial therewith or a plurality of rods, as well as the reaction material 2 is secured (connected) at its one end 21 to a lower portion of the elastic part 1 and a member 13, and the reaction material 2 is arranged at the other end 22 with a fluid cylinder 10 for a strain giving mechanism, and the elastic part 1 is equipped at its top with a cam for the strain energy releasing mechanism 4 with which an engaging part 11' connecting to a piston rod 11 of the strain giving mechanism is engaged. A numeral 12 is a fluid conduit.

In each of the embodiments, the driving operation is carried out by supplying the pressure fluid via the fluid conduit 12 into the fluid cylinder 10, causing the reaction material 2 to provide reaction under the compressive force by means of the fluid cylinder 10, giving thereby the tensile strain to the elastic part 1, rotating in an arrow direction the cam as the strain energy releasing mechanism 4, and abruptly releasing thereby the strain energy at the head of the elastic part, whereby the strain energy is transformed into the kinetic energy and this kinetic energy strikes the article on its head to generate the compressive stress wave, so that the article 3 is effectively driven into the object 5.

In the above embodiments the fluid pressure is employed for accumulating the strain energy, but of course the invention is not limited thereto.

From the above explanations, apparatuses for realizing various embodiments of the inventive method will be easily considered. For example, the method shown in FIG. 2 is easily realized by providing the strain energy releasing mechanism 4 such as the cam on the bottom of the elastic material 1 and providing the strain giving mechanism such that the compressive strain is given to the elastic part 1.

Further, the extracting of the already driven article 3' as shown in FIG. 7 may be carried out by providing the strain giving mechanism such as the fluid cylinder 10 in FIG. 13 and FIG. 14 so that the compressive strain is given to the elastic part 1. In addition, the method in FIG. 8 is practised by providing the strain energy releasing mechanism such as the cam on the bottom of the elastic part 1 in FIG. 13 and FIG. 14.

If the strain energy releasing mechanism 4 is arranged at the head and the bottom of the elastic part 1, respectively, in FIG. 13 and FIG. 14, an apparatus for the both of driving and extracting may be obtained.

The present invention is the driving and extracting method by receiving the energy between the substances contacting each other, and so the driving and extracting operations can be easily performed with high efficiency and with less loss owing to noise or vibration. In other words, the noise or vibration can be made less. Furthermore, since the driving and extracting operations may be provided in the same relation at time of collision of the substances having the velocity V, the impact theory, excellent in practice, may be applied and it is possible to make the high operating efficiency in comparison with the conventional static process or vibration process. The invention does not require the reaction mechanism necessary to the static process so that the apparatus structure may be simplified, and further the invention does not expect the accelerated speed by the gravity as the striking process and therefore the operations in the oblique and the horizontal directions are at the discretion.

We claim:

1. A method of driving articles and extracting articles by strain energy, wherein driving and extracting of the article are carried out by arranging an elastic part having a reaction material on said article at its head, accumulating strain energy in the elastic part via the reaction material, subsequently abruptly releasing the strain energy, and transforming thereby said strain energy into kinetic energy.

2. A method as claimed in claim 1, wherein said reaction material and said elastic part have properties with the following relation:

$$E_1/\rho_1 > E_2/\rho_2$$

wherein, $\rho_1$ is the density of the elastic part, $\rho_2$ is the density of the reaction material, $E_1$ is the elastic modulus of the elastic part, and $E_2$ is the elastic modulus of the reaction material.

3. A method of driving articles by strain energy, wherein driving of the article is carried out by arranging an elastic part having a reaction material on said article at its head, giving tensile strain to the elastic part via the reaction material, accumulating strain energy in the elastic part, subsequently abruptly releasing the strain energy from the head of the elastic material, transforming thereby said strain energy into kinetic energy, transmitting said kinetic energy to the article on its head, and generating a compressive stress wave in the article.

4. A method as claimed in claim 3, wherein said reaction material and said elastic part have properties with the following relation:

$$E_1/\rho_1 > E_2/\rho_2$$

wherein, $\rho_1$ is the density of the elastic part, $\rho_2$ is the density of the reaction material, $E_1$ is the elastic modulus of the elastic part, and $E_2$ is the elastic modulus of the reaction material.

5. A method of driving articles by strain energy, wherein driving of the article is carried out by arranging an elastic part having a reaction material on said article at its head, giving compressive strain to the elastic part via the reaction material, accumulating strain energy in the elastic part, subsequently abruptly releasing the strain energy from the bottom of the elastic part, and transforming thereby said strain energy into kinetic energy, transmitting said kinetic energy to the article on its head, and generating thereby a compressive stress wave in the article.

6. A method as claimed in claim 5, wherein said reaction material and said elastic part have properties with the following relation:

$$E_1/\rho_1 > E_2/\rho_2$$

wherein, $\rho_1$ is the density of the elastic part, $\rho_2$ is the density of the reaction material, $E_1$ is the elastic modulus of the elastic part, and $E_2$ is the elastic modulus of the reaction material.

7. A method of extracting, by strain energy, articles from an object into which the article has been driven, wherein extracting of the article is carried out by arranging an elastic part comprised of a reaction material on said article, giving compressive strain to the elastic part, accumulating thereby strain energy in the elastic part, subsequently abruptly releasing the strain energy from the head of the elastic part, transforming thereby said strain energy into kinetic energy, and giving an impact force in an extracting direction to the driven article by means of the elastic part having obtained the kinetic energy.

8. A method as claimed in claim 7, wherein said reaction material and said elastic part have properties with the following relation:

$$E_1/\rho_1 > E_2/\rho_2$$

wherein, $\rho_1$ is the density of the elastic part, $\rho_2$ is the density of the reaction material, $E_1$ is the elastic modulus of the elastic part, and $E_2$ is the elastic modulus of the reaction material.

9. A method of extracting, by strain energy, articles from an object into which the article has been driven, wherein extracting of the article is carried out by arranging an elastic part comprised of a reaction material on said article, giving tensile strain to the elastic part, accumulating thereby strain energy in the elastic part, subsequently abruptly releasing the strain energy from the bottom of the elastic part, transforming thereby said strain energy into kinetic energy, and extracting the article from an object by means of the elastic part having obtained the kinetic energy.

10. A method as claimed in claim 9, wherein said reaction material and said elastic part have properties with the following relation:

$$E_1/\rho_1 > E_2/\rho_2$$

wherein, $\rho_1$ is the density of the elastic part, $\rho_2$ is the density of the reaction material, $E_1$ is the elastic modulus of the elastic part, and $E_2$ is the elastic modulus of the reaction material.

11. An apparatus for driving and extracting articles, comprising an elastic part arranged on a head of an article, a reaction part connected to the elastic part, an energy giving means for imparting strain energy to the elastic part via the reaction material, and a strain energy releasing mechanism which abruptly releases said strain energy.

12. An apparatus for driving articles, comprising an elastic part arranged on a head of an article, a reaction material whose one end portion is provided at a bottom of the elastic part, a strain energy giving means for imparting strain energy to the elastic part positioned at another portion of the reaction material, and a strain energy releasing mechanism provided on a head of the elastic part for abruptly releasing the strain energy.

13. An apparatus for driving articles, comprising an elastic part arranged on a head of an article, a rod-shaped reaction material installed within the elastic part and connected at one end thereof to the elastic part, a fluid cylinder coupled to the reaction material at its other end, and a cam rotatably provided on the elastic part on its head and contacted with a piston rod of the fluid cylinder for imparting strain energy to said elastic part and for abruptly releasing same.

14. An apparatus for driving articles, comprising an elastic part arranged on a head of an article, a plurality of rod shaped reaction materials provided coaxially on an outer circumference of the elastic part and connected at one end thereof to a bottom of the elastic part, a plurality of fluid cylinders coupled to the reaction material at its other end, a single engaging portion commonly connected to piston rods of the fluid cylinders, and a cam rotatably provided on the elastic part at its head and contacted with the engaging portion for imparting strain energy to said elastic part and for abruptly releasing same.

15. An apparatus for driving articles, comprising an elastic part arranged on a head of an article, a rod shaped reaction material provided coaxially on an outer circumference of the elastic part and connected at one end thereof to a bottom of the elastic part, a plurality of fluid cylinders coupled to the reaction material at its other end, a single engaging portion commonly connected to piston rods of the fluid cylinders, and a cam rotatably provided on the elastic part at its head and contacted with the engaging portion for imparting strain energy to said elastic part and for abruptly releasing same.

* * * * *